US009556647B2

(12) United States Patent
Bunch

(10) Patent No.: US 9,556,647 B2
(45) Date of Patent: Jan. 31, 2017

(54) HIGH SECURITY STRIKER BOX

(71) Applicant: Jowel Dee Bunch, Houston, TX (US)

(72) Inventor: Jowel Dee Bunch, Houston, TX (US)

(73) Assignee: STRIKER BOX DOOR SECURITY PRODUCTS, LLC, Houston, TX (US)

( * ) Notice: Subject to any disclaimer, the term of this patent is extended or adjusted under 35 U.S.C. 154(b) by 69 days.

(21) Appl. No.: 14/524,722

(22) Filed: Oct. 27, 2014

(65) Prior Publication Data

US 2016/0115710 A1 Apr. 28, 2016

(51) Int. Cl.
*E05B 15/02* (2006.01)
*E05B 17/20* (2006.01)

(52) U.S. Cl.
CPC ..... *E05B 15/0205* (2013.01); *E05B 17/2084* (2013.01)

(58) Field of Classification Search
CPC .... E05B 15/024; E05B 15/025; E05B 15/029; E05B 17/2084; E05B 2015/0215
USPC ..... 292/340, 341, 341.14–341.18
See application file for complete search history.

(56) References Cited

U.S. PATENT DOCUMENTS 434,732 A 8/1890 Sonedecker
1,350,299 A * 8/1920 Crouch ..... E05C 1/16 292/340
1,479,371 A 1/1924 Moskowitz
2,446,206 A 8/1948 Beckman
4,105,235 A 8/1978 Thiel
4,113,293 A * 9/1978 Paquette ..... E05B 15/025 292/341.18
4,130,311 A 12/1978 Sushan
4,186,954 A 2/1980 Detlefs
4,195,870 A 4/1980 Percoco
5,257,841 A * 11/1993 Geringer ..... E05B 45/083 292/340
5,474,347 A 12/1995 Vigneault
6,834,897 B1 12/2004 Walker
D531,485 S 11/2006 Cutler
2003/0057718 A1 3/2003 Stoehr
2010/0201138 A1 8/2010 Sauder

* cited by examiner

*Primary Examiner* — Mark Williams

(57) ABSTRACT

A striker box assembly provides enhanced security when locking a door where the assembly includes a box and a cover plate which are secured to a stud in the frame around the doorway in at least three ways. The first way of securing the assembly is with screws in a jack flange that extends along a lateral side of the stud in flush contact therewith. The second manner is with a screw in the bottom of the box to hold the box firmly against the stud or through shims or a boot that solidly fills any gap between the bottom of the box and the stud. The third way is with offset screws that extend through the cover plate and the box into the stud. The cover plate includes a flange that provides additional strength to resist destructive forces involved when a person attempts to break down a door.

10 Claims, 5 Drawing Sheets

HIGH SECURITY STRIKER BOX

CROSS-REFERENCE TO RELATED APPLICATIONS

None.

STATEMENT REGARDING FEDERALLY SPONSORED RESEARCH OR DEVELOPMENT

None.

FIELD OF THE INVENTION

This invention relates to strikes or striker plates used for locking doors. A strike or striker plate is typically installed in the jamb of a door to receive a bolt latch of a lock such as a deadbolt so that together, they securely hold the door closed.

BACKGROUND OF THE INVENTION

To securely lock a door, one needs or wants a strong door, a strong door frame, a strong latch and a strong strike or striker plate. Like a chain, the combined strength of the locked door is limited by the strength of the weakest of the these elements.

Focusing on the strike or striker plate, at an outside door to be securely locked, it is common to have a strong striker plate comprised of steel that is screwed into and maybe through the door jamb into the underlying supporting structure. One might use extra-long screws to hold the striker plate not just to the jamb, but also to a 2×4 stud behind the jamb that is part of the structure of the wall. However, even thicker steel striker plates with extra-long screws may be quickly defeated by a motivated thief that is able to apply a powerful kick to the door near the lock and the striker plate. The screws may hold firm to the 2×4 stud, but the striker plate is typically spaced about an inch from the 2×4 stud. The screws may have a lot of tensile strength, but they do bend. With the screws extending an inch out from the stud, such impacts from kicking the door may bend the screws sufficiently to allow the striker plate to pivot inwardly so that latch may slip out of the hole in the striker plate. The bending screws also are levers to break apart the jamb and the 2×4 studs, which is a second mode of failure of the striker plate. Regardless of the strength of the door and the strength of the latch, if the striker plate fails, the doorway may be breached based on the failure of the simplest and smallest element for an outside security door.

While stronger materials are being continually developed, there is a need for a simple, but effective strike or striker plate to work with stronger doors and stronger latches to provide better security for people and things. There is a need for an improved design for a striker plate to take better advantage of the underlying structure of a doorway opening.

BRIEF SUMMARY OF THE DISCLOSURE

The invention relates to a striker box assembly comprising a box, a cover plate and a boot. The box comprises four connected lateral walls where a first lateral wall is an inner wall, a second lateral wall is a back wall that is opposite the inner wall, a third lateral wall is an upper wall and the fourth of the four lateral walls is a lower wall. The four lateral walls are connected end to end to form a generally rectangular shape. The box further has an open front and a boot flange opposite the open front of the box and which is attached to at least three of the four connected lateral walls at a bottom of the box and arranged generally perpendicular to all four lateral walls. The box further includes a jack flange attached at or near the bottom of the inner wall and arranged to extend away from the open front of the box beyond the jack flange of the box. An upper wing of the box is attached to the upper wall at or near the open front of the box and arranged to extend away from the lower wall. A lower wing of the box is attached to the lower wall at or near the open front of the box and arranged to extend away from the upper wall and away from the upper wing. A base wing of the box is attached to the inner wall at the open front and arranged to extend away from the back wall, wherein the wings are generally arranged to be in a common plane that is generally parallel to the boot flange. The cover plate is attached to the wings of the box wherein the cover plate comprises a face plate and a back flange oriented generally perpendicular to the face plate. The face plate further has a hole arranged to receive a latch of a door locking system wherein the latch may enter into the hole and into the box such that the box and cover plate together resist against lateral movement of the latch which would occur when the door is to be opened. The boot is attached to the boot flange and has a foot side for being positioned flush against a structural element such as a stud within wall at the frame of a door in which the box is suited for installation.

The invention may also be described as related to an installed striker box assembly comprising a jack stud, a door jamb arranged generally flush against the jack stud, a box attached into the door jamb and to the jack stud, and a cover plate attached to the box. The box comprises four connected lateral walls where a first lateral wall is an inner wall, a second lateral wall is a back wall that is opposite the inner wall, a third lateral wall is an upper wall and the fourth of the four lateral walls is a lower wall, wherein the four lateral walls are connected end to end to form a generally rectangular shape. The box has an open front and a boot flange positioned opposite the open front and attached to at least three of the four connected lateral walls at a bottom of the box and arranged generally perpendicular to all four lateral walls. The boot flange is particularly arranged to have firm contact directly or indirectly with the jack stud. The box further includes a jack flange attached at or near the bottom of the inner wall and arranged to extend away from the open front of the box beyond the jack flange of the box. An upper wing of the box is attached to the upper wall at or near the open front of the box and arranged to extend away from the lower wall. A lower wing of the box is attached to the lower wall at or near the open front of the box and arranged to extend away from the upper wall and away from the upper wing. A base wing is attached to the inner wall at the open front and arranged to extend away from the back wall. All of the wings are generally arranged to be in a common plane that is also generally parallel to the boot flange. The cover plate is attached to the wings wherein the striker plate comprises a face plate and a structural flange oriented generally perpendicular to the face plate wherein the face plate has a hole arranged to receive a latch of a door locking system wherein the latch may enter into the hole and into the box such that the box and cover plate resist against lateral movement of the latch. The assembly further includes machine screws holding the cover plate to the box, a primary screw through the boot flange into the jack stud, at least one jack screw through the jack flange into the jack stud at substantial angle to the primary screw and at least two secondary screws holding the cover plate to the box and firmly to the jack stud.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
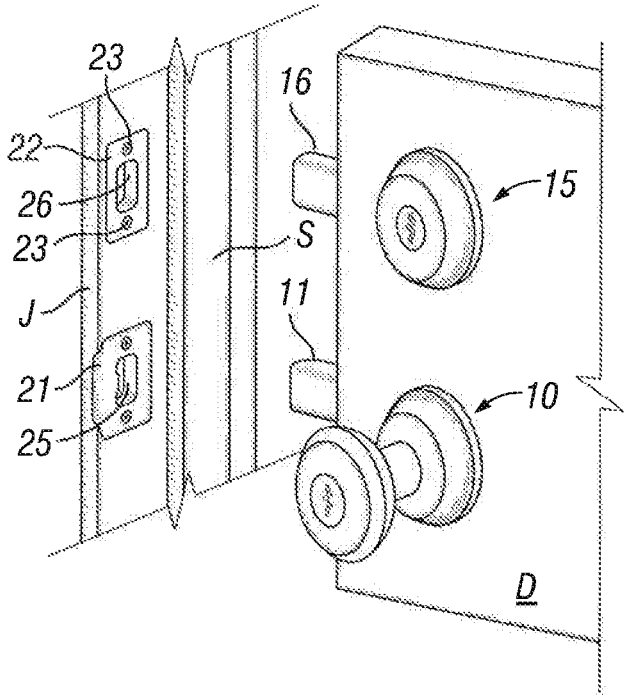
FIG. 1 (Prior Art)
FIG. 1 is a perspective view of a door having a door knob and a deadbolt lock each of which are arranged to latch into conventional prior art striker plates.

Turning now to FIG. 1, a conventional door D is shown that swings closed to a door jamb J and stops against door stop S. Once closed, a spring latch 11 engages a strike or striker plate 21 attached to the jamb by descending into the opening 25 in the striker plate 21. The door D may be re-opened by turning the knob 10 to pull the spring latch 11 from the striker plate 21. However, to securely lock the door D, a deadbolt 15 having a bolt latch 16 engages striker plate 22 by descending into opening 26 in the striker plate 22. The bolt latch may be hardened steel and the deadbolt is designed to prevent the withdrawal of the bolt latch 16 unless the cylinder is properly engaged by a key or the inside thumb switch (neither of which is shown).

Figure 2:
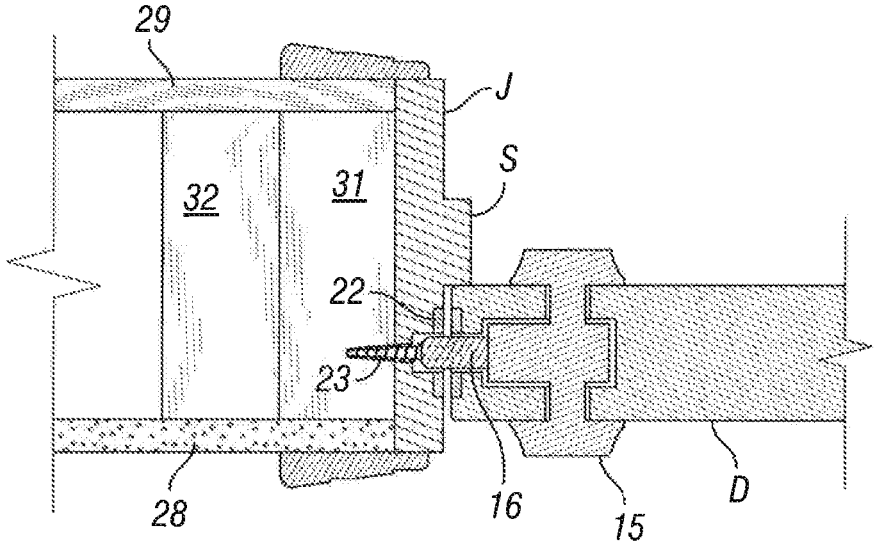
FIG. 2 (Prior Art)
FIG. 2 is a top sectional view of the door closed with the latch of the deadbolt extended into and engaged with the conventional striker plate in the door jamb while the door is closed against the door stop.
Figure 3:
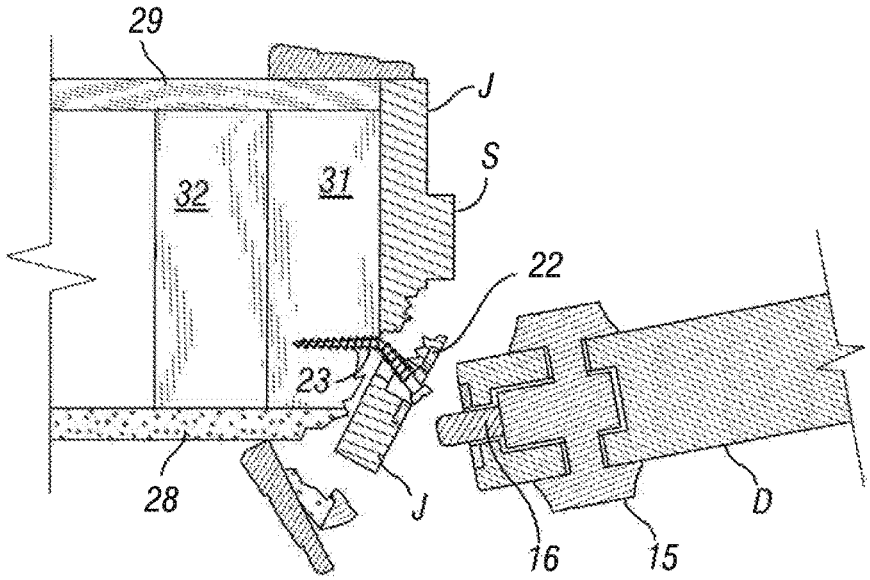
FIG. 3 (Prior Art)
FIG. 3 is a second top cross sectional view showing the failure of a conventional striker plate when the door has been kicked open.

Referring to FIG. 2, the bolt latch 16 is shown fully extended into the opening 26 in the striker plate 22 to resist opening of the door. As shown in FIG. 3, if a powerful force is applied from the outside of the inwardly swinging door D, such as from a person kicking or charging the door or by some type of battering ram, the screws 23 holding the striker plate to the jamb J and perhaps the jack stud 31 tend to bend inwardly. Eventually, the jamb J breaks and the bolt latch 16 pops loose from the striker plate 22 as the striker plate rolls away from the door stop S. The length that the screws extend out from the jack stud 31 also tends to give leverage to the forces being applied to the striker plate and tears up the jamb J and the jack stud 31, especially if the screws 23 are installed close to the edge or inside lateral face of the stud 31.

It should be noted that most conventional doors are framed with jack studs on either side of the opening with a header spanning across the top of the rough opening. Flush against the jack studs are king studs which extend fully to the top plate.

FIGS. 1-3 are prior art arrangements.

Turning now to the present invention shown in FIGS. 4, 5, 6 and 7, a striker box assembly is shown comprising a cover plate 40 and a box 50. The box 50 is the central element in the striker box assembly and comprises a number of elements that are best shown in FIGS. 5, 6, 7 and 10. It should first be understood that the box 50 should be made of strong and robust material. It would be expected that the box 50 would be made of steel and that the walls would have a robust dimension. For example, the thickness of the walls of the box 50 might be between about 1/32" and about 3/16" steel depending on the security desired for the door D.

The box 50 includes four connected lateral walls 61, 52, 54 and 55. The first lateral wall 61 is also an inner wall 61. A second lateral wall 53 is also a back wall 52 that is opposite the inner wall 61. A third lateral wall 54 is also an upper wall 54 and the fourth lateral wall 55 of the four lateral walls is a lower wall 55. The four lateral walls are connected end to end to form a rectangular shape. The box 50 has an open front or top and a bottom wall 58 that at least partially closes the bottom of the box 50. The bottom wall 58 may optionally extend fully across that bottom of the box so that it is closed on five sides and open on the front or top, but in the preferred embodiment, it is partially closed on the bottom. The bottom wall 58 is also called the boot flange 58 and is arranged generally perpendicular to the four lateral walls 61, 52, 54 and 55.

The back wall 52, the upper wall 54 and lower wall 55 all have a common depth dimension when considering the dimension from the front or top of the box 50 to the bottom. However, inner wall 61 includes a portion that extends beyond the bottom wall 58. This extended portion may be called a jack flange. It may be viewed by some that it is not clear where the inner wall 61 ends and the jack flange begins, but it may be viewed or understood that the jack flange begins about where the plane of the bottom wall 58 intersects the inner wall 61. The function of the jack flange 61 will be explained below.

The box 50 further includes an upper wing 62 attached to the upper wall 54 and which extends generally flush with the open top of the box 50 and generally perpendicular to the upper wall 54. Similarly, a lower wing 63 is attached to the lower wall 55 and which extends generally flush with the open top of the box and generally perpendicular to the lower wall 55. It should be noted that these wings 62 and 63 extend away from the interior of the box.

The box 50 further includes a base wing 65 that is somewhat similar to the upper and lower wings 62 and 63, but attaches to the inner wall 61 and which extends generally flush with and away from open front of the box 50 and generally perpendicular to the inner wall 61. Preferably, the three wings 62, 63 and 65 generally lie in a common plane.

Figure 4:
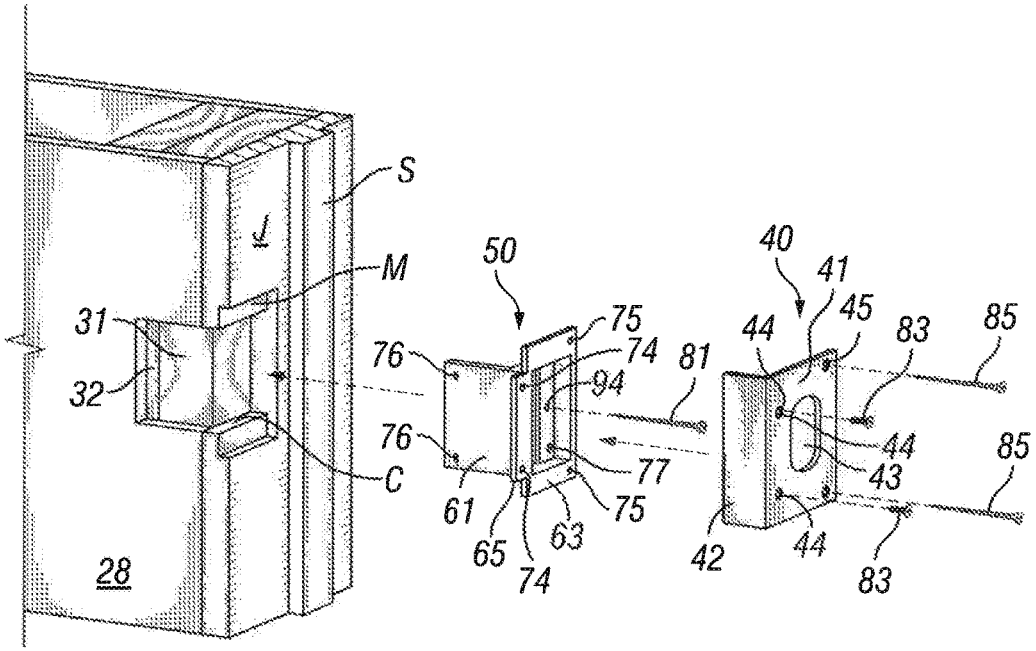
FIG. 4 is an exploded view of the striker box and the cover plate oriented to be installed into a door jamb.
Figure 5:
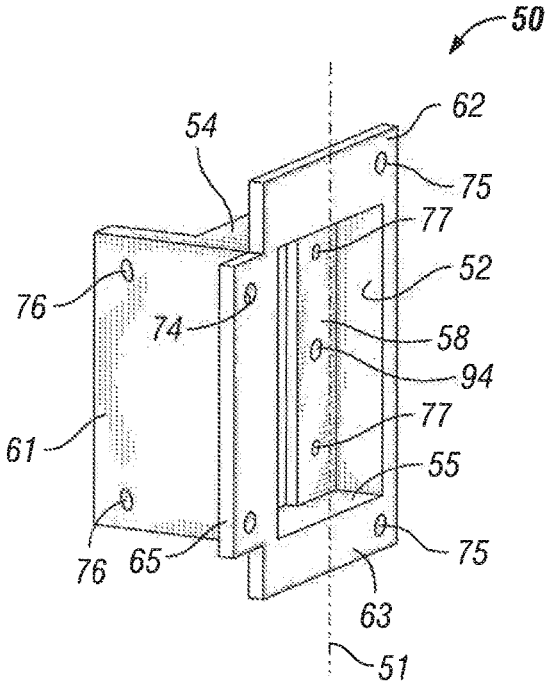
FIG. 5 is a perspective view of the box according to the present invention.
Figure 6:
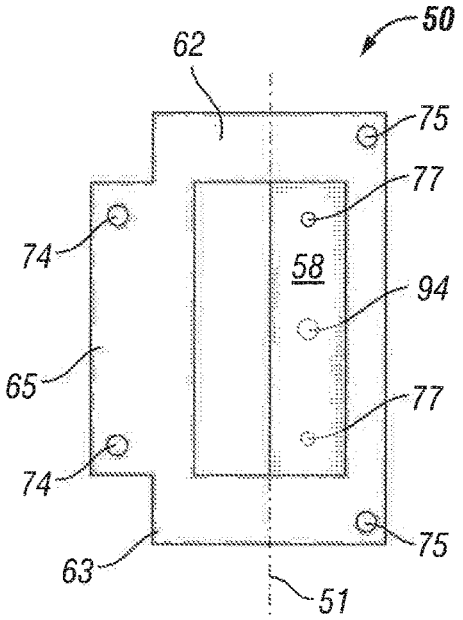
FIG. 6 is front view of the box of the present invention.
Figure 7:
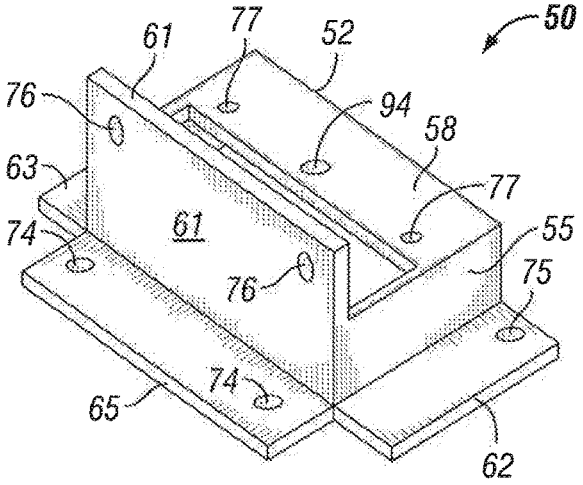
FIG. 7 is a bottom perspective view of the box providing an alternative angle to better understand the structure of the box.

Looking back at FIG. 4, the cover plate 40 includes a face plate 41 and a back flange 42. The face plate 41 is arranged to cover the open top or front of the box 50 and includes a main opening 43 and two sets or pairs of screw holes 44 and 45 (for a total of four screw holes). The box 50 includes two sets or two pairs of screw holes 74 and 75 in the wings 62, 63 and 65 which are arranged to align with screw holes 44 and 45, respectively, of the cover plate 40. The screw holes 74 in the base wing 65 are preferably provided with threads for securely receiving machine screws 83. Once assembled, the cover plate 40 is attached to the box 50 by the machine screws through the holes 44 and threaded into the holes 74. Screw holes 45 and 75 do not have screw threads but are arranged to have secondary long screws 85 secure the cover plate 40 and box 50 together and to the door jamb J.

Still focusing on FIG. 4, prior to installation of the striker box assembly, a portion of the door jamb J is cutout exposing the jack stud 31. A similar cutout is made in the drywall 28 exposing the side or lateral face of the jack stud 31 and possibly part of the king stud 32, into this cutout, the box 50 is positioned for installation. Typically, a surface portion of the door jamb J would also be removed with a chisel by mortising a recess M both above and below the cutout C to let the upper and lower wings 62 and 63 recess below the face surface of the door jamb J at a sufficient depth so that the cover plate 40 ends up generally flush with the same face surface of the door jamb J.

Figure 8:
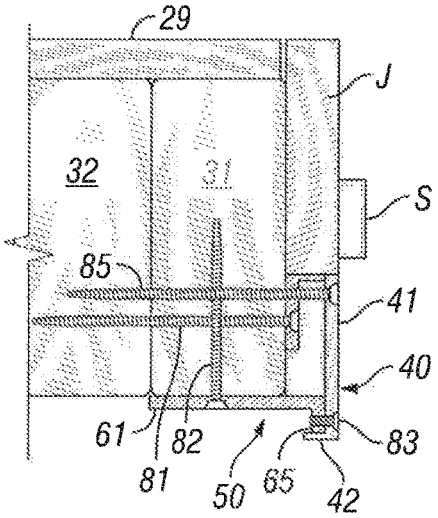
FIG. 8 is a top cross sectional view of the box and cover plate attached firmly to the stud.
Figure 9:
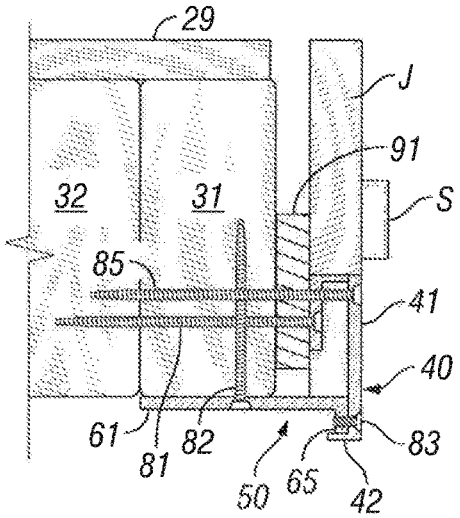
FIG. 9 is a top cross sectional view like FIG. 8 showing the jamb spaced from the stud, but where the box and cover plate are installed firmly to the stud using a shim or pair of shims to fill the space between the back wall of the box and the stud.

As shown in FIG. 8, the box 50 would first be attached to the jack stud 31 by a primary screw 81 through a screw hole 94 or by a pair of primary screws 81 through screw holes 77 in the bottom wall 58. The attachment of the box 50 to the jack stud 31 will be strongest if the bottom wall 58 is flush against the jack stud 31 as shown in FIG. 8. However, in most situations, the door jamb J is spaced somewhat from the jack stud 31 to make the door jamb J square, straight and vertical. Also, the frame for the door (which includes door jamb J) is typically slightly smaller than the rough opening in the wall for the door. Centering the frame in the door creates space between the door jamb J and the jack stud 31. Typically, shims are used to fill the space and firmly attach the jamb J to the jack stud 31. In the present invention as shown in FIG. 9, a shim 91 is also used to fill the space between the bottom wall 58 and the jack stud 31 providing firm support to the box 50 and the striker assembly from the jack stud 31. A shim is a thin wedge typically made of wood, but may be plastic or metal and is inserted into the space between the bottom wall 58 and the jack stud 31 until the shim 91 is in contact with both at the same time. With the shim 91 in place, the primary screw or screws 81 is/are installed through the shim 91 to hold the box 50 in position.

Figure 10:
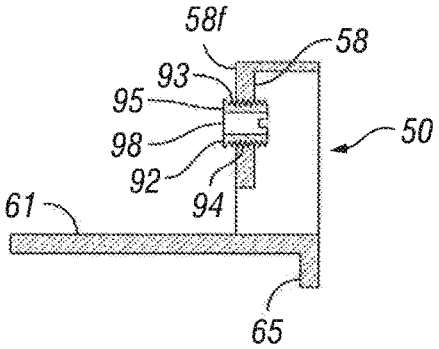
FIG. 10 is a top cross sectional view of an embodiment of the box with an adjustable boot installed therein for adapting the box to fit various door installations with the normal varying dimensions of spacings between the jamb and the supporting stud.
Figure 11:
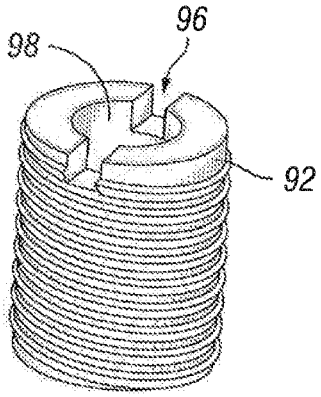
FIG. 11 is a perspective view of the boot.
Figure 12:
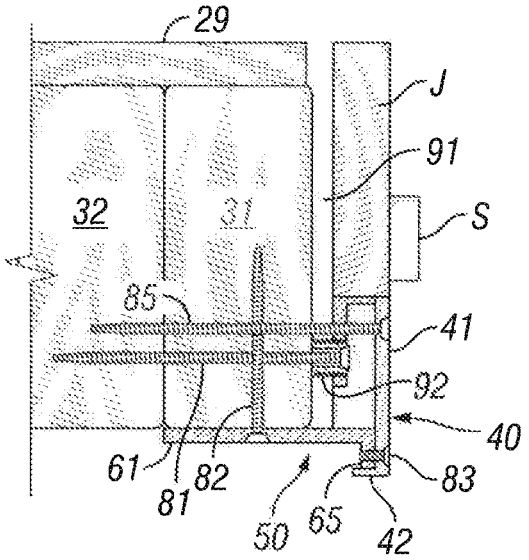
FIG. 12 is a top cross sectional view like FIG. 8 showing the boot filling the space between the back wall of the box and the stud.

A third alternative installation arrangement is shown in FIGS. 10, 11 and 12 where hole 94 in bottom wall 58 is a threaded hole and a boot 92 having screw threads 93 is arranged to engage the threads of the threaded hole 94 and extend to from the bottom wall 58 to the jack stud 31. It is this configuration where the bottom wall 58 is sometimes called a boot flange 58 as it provides the connection of the boot 92 to the box 50 and gains the support of the jack stud 31 for the box 50 and the striker box assembly. By simple rotation of the boot 92, the distance between the bottom surface 95 of the boot 92 and the bottom face **58*f* of the bottom wall 58 may be adjusted. The boot, as shown in FIG. 11 has a slot 96 suitable for turning with a straight bladed screw driver. By trial and error, the depth of the boot is adjusted until the box 50 may be positioned in the cutout at the right depth with respect to the door jamb J and the bottom surface 95 of the boot 92 is flush to the jack stud 31. It is preferred that the boot have the same diameter as the threaded portion 93 so that the boot may fully or nearly fully recessed into the box 50 in the event that the door jamb J is quite close or flush with the jack stud 31. Center bore 98 within the boot 92 is arranged to receive the primary screw 81 to hold the boot 92 to the jack stud 31 and thereby secure the box 50** firmly in place within the cutout.

For all the embodiments, a set of jack screws 82 are used to attach the inner wall or jack flange 61 to the jack stud 31 via screw holes 76. It should be noted that jack screws 82 are oriented generally perpendicular to the primary screw 81. Having these screws at such strongly divergent angles makes it so only one screw is oriented in a weaker orientation for failure under a destructive load while the other screw is in a stronger orientation to resist failing. For example, if a fully inserted screw is weakest in pure tension, then if the box 50 were being pulled straight out from the door jamb J, jack screw 82 would strongly resist that load and tend to provide support for primary screw 81 preventing he primary screw 81 from failing. If the load were shifted to push the box 50 inwardly into the room in which the door would swing when opened, the jack screw 82 would be in tension, but the primary screw 81 would be in an orientation to the load that would be able to provide the additional resistance to this second type of load or force. Secondly, with the box 50 secured by a jack flange 61 to the side of the jack stud 31, the box 50 is better prevented from rolling or rotating in the cutout while the door D is being forced open.

After the box 50 is attached to the jack stud 31 by primary screw or screws 81 and jack screws 82, cover plate 40 is attached to the box by machine screws 83. A third way of attaching the box 50 along with the cover plate 40 to the jack stud 31 is with secondary screws 85 that extend through screw holes 45 in the cover plate 40 and screw holes 75 in the box 50 and then through the jack stud 31 and into king stud 32. The screw holes 45 and 75 align such that the screws 85 hold the cover plate 40 and the box 50 together while attaching to the jack stud 31 and king stud 32. It should be noted that the screw holes 75 are off center relative to the box 50 (as identified by centerline 51 in FIGS. 5 and 6) and especially with respect to the main opening 43 in the cover plate 40 so that the secondary screws 85 will be positioned closer to the center of the jack stud 31 as shown in FIGS. 8, 9, 12 and 13 and further away from the edge of the jack stud 31 to avoid the vulnerability of tearing up the jack stud as described when discussing FIGS. 2 and 3 above. Focusing on FIG. 6, the center line 51 is shown extending vertically across the face or front opening of the box 50 and the holes 75 are positioned on the opposite side of the centerline from the jack flange 61 and closer to the inner wall 52. It should also be noted that the center bore 98 is arranged to be outside the alignment of the screw holes 75 and 77 to reduce the probability that all three screws will hit the same grain line in the wood. If all three screws hit the same grain line, the stud would be likely to split and be seriously weakened.

One feature of the invention that provides additional strength to the striker box assembly is the way the inner wall 61, the base wing 65 and the back flange 42 are arranged to create a U-channel as seen in FIGS. 8, 9, 12 and 13. This U-channel provides resistance to distortion of the striker box assembly under a severe load in a manner similar to the way an I-beam or a piece of channel iron resists bending.

Another aspect of the striker box assembly is that the boot 92 is arranged to be offset from where the latch 16 may set into the box 50. The box 50 is generally preferred to be about ⅝" in depth to work with a conventional jamb dimension of 11/16".

Figure 13:
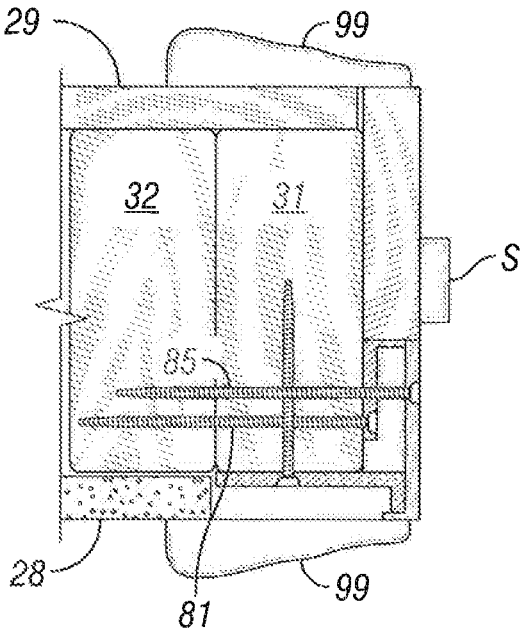
FIG. 13 is a top cross sectional view like FIG. 8 showing the finish carpentry including drywall and trim around the doorway.

When the drywall 28 and door trim 99 are attached as shown in FIG. 13, the striker box assembly will appear to be reasonably similar to conventional systems and the cutout will not be visible.

Ultimately, the striker box assembly will only be as strong as the materials from which it is constructed and to which it is attached. This invention is intended to take as much advantage of the available structure within the wall surrounding the door as possible in a cost considered manner and reduce the likelihood of failure of the door system based on the striker being the weak link.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A striker box assembly for providing a stronger, more secure striker for a latch of a door locking system when installed in a door jamb, the assembly comprising:

a box that comprises four connected lateral walls where a first lateral wall is an inner wall, a second lateral wall is a back wall that is opposite the inner wall, a third lateral wall is an upper wall and the fourth of the four lateral walls is a lower wall, wherein the four lateral walls are connected end to end to form a generally rectangular shape, the box has an open front and a boot flange opposite the open front attached to at least three of the four connected lateral walls at a bottom of the box and arranged generally perpendicular to all four lateral walls, at least one primary screw hole is located in the boot flange suited to receive a primary screw through the primary screw hole to hold the box to a stud in a wall adjacent the door jamb when the box is installed in the door jamb, the box further includes a jack flange attached at or near the bottom of the inner wall and arranged to extend away from the open front of the box beyond the boot flange of the box, at least one jack screw hole is located in the jack flange suited to receive a jack screw through the jack screw hole into the stud in the wall adjacent the door jamb when the box is installed in the door jamb, wherein each of the primary screw hole and jack screw hole have an axis and the axis of the primary screw hole is generally perpendicular to the axis of the jack screw hole, the box further including an upper wing that is attached to the upper wall at or near the open front of the box and arranged to extend away from the lower wall, a lower wing attached to the lower wall at or near the open front of the box and arranged to extend away from the upper wall and away from the upper wing, and further including a base wing attached to the inner wall at the open front and arranged to extend away from the back wall, wherein the wings are generally arranged to be in a common plane that is generally parallel to the boot flange;

a cover plate attached to the wings wherein the cover plate comprises a face plate and a back flange oriented generally perpendicular to the face plate wherein the face plate has a hole that is arranged to receive the latch of the door locking system wherein the latch may enter into the hole and into the box such that the box and cover plate together resist against lateral movement of the latch which would occur when the door is to be opened; and a boot attached to the boot flange and having a foot side for being positioned flush against a stud or structural element within wall at the frame of a door in which the box is suited for installation; whereby the combination of the box with the boot and cover plate are suited to be installed in a door frame and when installed is very securely attached to the stud or structural element by screws oriented generally perpendicular to one another within the wall at the doorframe and strongly resist force and impacts that are intended to breach the door when closed and locked.

2. The striker box assembly in accordance with claim 1, wherein the boot is attached in a manner that allows for adjustment during installation to move into contact with a structural element in the wall, but resists movement relative to the boot flange once the box assembly is installed in a door jamb.

3. The striker box assembly in accordance with claim 2, wherein the boot has screw threads engaged with screw threads on the boot flange so that rotation of the boot causes the boot to move perpendicular to the boot flange and thereby adjust the boot relative to the frame.

4. The striker box assembly in accordance with claim 3, wherein the boot further includes a slot for a straight bladed screw driver to turn the boot and thereby utilize the screw threads and adjust the perpendicular location of the boot in the boot flange so as to be positioned into firm contact with the door frame when installed.

5. The striker box assembly in accordance with claim 1, wherein each of the wings is rectangular in shape.

6. The striker box assembly in accordance with claim 1 wherein the face plate is screw attached to the base wing and the back flange is spaced from the inner wall such that the back flange, the inner wall, the face plate and the base wing are arrange to form a U-channel to strengthen the striker assembly from deformation.

7. The striker box assembly in accordance with claim 1 further including secondary screw holes in each of the cover plate and box that are aligned when the cover plate and box are assembled together for secondary screws to extend through the secondary screw holes to secure the cover plate and box together and the assembly against the stud in the wall.

8. An installed striker box assembly for providing a stronger, more secure striker for a latch of a door locking system, the assembly comprising:

a jack stud in a wall defining one side of a rough door opening;

a door jamb arranged generally flush against the jack stud wherein the door jamb defines a finished door opening within a rough door opening;

a box that comprises four connected lateral walls where a first lateral wall is an inner wall, a second lateral wall is a back wall that is opposite the inner wall, a third lateral wall is an upper wall and the fourth of the four lateral walls is a lower wall, wherein the four lateral walls are connected end to end to form a generally rectangular shape, the box has an open front and a boot flange opposite the open front attached to at least three of the four connected lateral walls at a bottom of the box and arranged generally perpendicular to all four lateral walls and arranged to have firm contact indirectly with the jack stud, at least one primary screw hole is located in the boot flange with a primary screw extending through the primary screw hole and into the jack stud to hold the box to the jack stud, the box further includes a jack flange attached at or near the bottom of the inner wall and arranged to extend away from the open front of the box beyond the boot flange of the box and be flush against the jack stud, at least one jack screw hole is located in the jack flange with a jack screw extending through the jack screw hole and into the jack stud holding the jack flange against the jack stud, wherein the primary screw hole and jack screw are also arranged to be generally perpendicular to one another, the box further including an upper wing attached to the upper wall at or near the open front of the box and arranged to extend away from the lower wall, a lower wing attached to the lower wall at or near the open front of the box and arranged to extend away from the upper wall and away from the upper wing, and further including a base wing attached to the inner wall at the open front and arranged to extend away from the back wall, wherein the wings are generally arranged to be in a common plane that is generally parallel to the boot flange;

a cover plate attached to the wings wherein the cover plate comprises a face plate and a structural flange oriented generally perpendicular to the face plate wherein the face plate has a hole arranged to receive a latch of a door locking system wherein the latch may enter into the hole and into the box such that the box and cover plate resist against lateral movement of the latch;

a boot attached to the boot flange and having a foot side positioned flush against the jack stud; and machine screws holding the cover plate to the box, and at least two secondary screws holding the cover plate to the box and firmly to the jack stud; whereby the combination of the box with the boot and cover plate installed in the door jamb in contact with the jack stud and screwed to the jack using screws that are oriented in at least two generally perpendicular directions is very securely attached to the jack stud and strongly resists force and impacts that are intended to breach the door when closed and locked.

9. The installed striker box assembly in accordance to claim 8 wherein the secondary screws are positioned offline with respect to the primary screw.

10. The installed striker box assembly in accordance with claim 8 wherein the box has a vertical centerline and the primary and secondary screws are positioned on the opposite side of the centerline of the box from the inner wall.

* * * * *